US010837289B2

(12) United States Patent
Bang et al.

(10) Patent No.: US 10,837,289 B2
(45) Date of Patent: Nov. 17, 2020

(54) GAS TURBINE BLADE

(71) Applicant: DOOSAN HEAVY INDUSTRIES CONSTRUCTION CO., LTD., Gyeongsangnam-do (KR)

(72) Inventors: Myeong Hwan Bang, Busan (KR); Ik Sang Lee, Gyeonggi-do (KR)

(73) Assignee: Doosan Heavy Industries Construction Co., Ltd., Gyeongsangnam-do (KR)

( * ) Notice: Subject to any disclaimer, the term of this patent is extended or adjusted under 35 U.S.C. 154(b) by 343 days.

(21) Appl. No.: 15/387,148

(22) Filed: Dec. 21, 2016

(65) Prior Publication Data

US 2018/0003062 A1 Jan. 4, 2018

(30) Foreign Application Priority Data

Jul. 4, 2016 (KR) ..... 10-2016-0084232

(51) Int. Cl.
*F01D 5/18* (2006.01)
*F01D 25/12* (2006.01)

(52) U.S. Cl.
CPC ..... *F01D 5/187* (2013.01); *F01D 25/12* (2013.01); *F05D 2220/32* (2013.01); *F05D 2240/301* (2013.01); *F05D 2260/22141* (2013.01)

(58) Field of Classification Search
CPC . F01D 5/189; F01D 5/187; F01D 9/04; F23R 3/005; F23R 3/002; F23R 2900/03045; F05D 2220/32; F05D 2240/126; F05D 2240/221; F05D 2240/2212; F05D 2240/2214; F05D 2240/22141; F05D 2250/12; F05D 2260/22141; F02B 29/0418
USPC ..... 416/97 R; 29/889
See application file for complete search history.

(56) References Cited

U.S. PATENT DOCUMENTS 4,514,144 A * 4/1985 Lee ..... B22C 9/04 416/96 R
6,446,710 B2 * 9/2002 Beeck ..... F01D 5/187 137/809
7,192,251 B1 * 3/2007 Boury ..... F01D 5/187 416/97 R (Continued)

FOREIGN PATENT DOCUMENTS

JP 63075502 U1 5/1988
JP 2001173403 A * 6/2001

(Continued)

OTHER PUBLICATIONS

Matsuda, Hisashi; Cooling member, Google Patents Translation—JP-2001173403-A (Year: 2001).*

(Continued)

*Primary Examiner* — David E Sosnowski
*Assistant Examiner* — Hakeem M Abdellaoui
(74) *Attorney, Agent, or Firm* — Invenstone Patent, LLC

(57) ABSTRACT

A gas turbine blade includes a plurality of guide ribs spaced apart from each other in a movement direction of a cooling fluid in order to guide movement of the cooling fluid flowing along a cooling passage formed in the turbine blade, and an opening formed in each of the guide ribs in order to guide a portion of the cooling fluid to a bottom of the cooling passage between the guide ribs or to side walls adjacent to the bottom.

8 Claims, 10 Drawing Sheets

(56) References Cited

U.S. PATENT DOCUMENTS

| | | | | |
|---|---|---|---|---|
| 8,511,977 | B2 * | 8/2013 | Hillier | F01D 5/18 415/178 |
| 8,689,858 | B2 * | 4/2014 | Rothenhofer | F28D 1/0366 165/166 |
| 9,127,561 | B2 * | 9/2015 | Boyer | F01D 5/187 |
| 10,287,893 | B2 * | 5/2019 | Cho | F01D 5/187 |
| 2006/0051208 | A1 * | 3/2006 | Lee | F01D 5/187 416/97 R |
| 2016/0069194 | A1 * | 3/2016 | Bommisetty | F01D 5/188 416/96 R |
| 2017/0016338 | A1 * | 1/2017 | Porter | F01D 9/041 |
| 2017/0234151 | A1 * | 8/2017 | Spangler | F01D 5/188 415/115 |

FOREIGN PATENT DOCUMENTS

| | | | |
|---|---|---|---|
| JP | 2001173403 | A | 6/2001 |
| KR | 1020150063950 | A | 6/2015 |
| WO | 2007094212 | A1 | 8/2007 |

OTHER PUBLICATIONS

Korean Office Action issued by the Korean Intellectual Property Office dated Mar. 24, 2017.

* cited by examiner

GAS TURBINE BLADE

CROSS-REFERENCE TO RELATED APPLICATION

This application claims priority to Korean Patent Application No. 10-2016-0084232, filed on Jul. 4, 2016, the disclosure of which is incorporated herein by reference in its entirety.

BACKGROUND

Exemplary embodiments of the present disclosure relate to a gas turbine blade capable of improving heat transfer performance by virtue of a plurality of guide ribs arranged along a cooling passage formed in the turbine blade.

A variety of methods of increasing a turbine inlet temperature have been proposed in order to improve the performance of a gas turbine engine. However, when the turbine inlet temperature is increased, the thermal load of a turbine blade is increased, and for this reason the life thereof may be shortened.

In particular, due to the thermal load which is structurally generated in the turbine blade, the method of forcibly cooling the turbine blade using a cooling fluid supplied thereto is carried out.

Such a forced cooling method is a method of supplying a cooling fluid, which is discharged from a compressor of a turbine, to a blade through a passage in the blade, and of generating forced convection so as to cool the blade. In the cooling method using forced convection, an uneven profile is used to improve cooling performance. The uneven profile is used to improve heat transfer by disturbing a flow in the passage.

A plurality of bar-shaped ribs obliquely arranged may be used for cooling. However, since cooling performance may vary depending on the angle of inclination of each of the ribs, countermeasures are required.

BRIEF SUMMARY

An exemplary object of the present disclosure is to provide a turbine blade capable of improving cooling efficiency by changing the structure of a guide rib in order to improve heat transfer performance using a cooling fluid flowing along a cooling passage in the turbine blade.

Other objects and advantages of the present disclosure can be understood by the following description, and become apparent with reference to the embodiments of the present disclosure. Also, it is obvious to those skilled in the art to which the present disclosure pertains that the objects and advantages of the present disclosure can be realized by the apparatus and methods as claimed and combinations thereof.

In accordance with one aspect of the present disclosure, a gas turbine blade includes a plurality of guide ribs spaced apart from each other in a movement direction of a cooling fluid in order to guide movement of the cooling fluid flowing along a cooling passage formed in the turbine blade, and an opening formed in each of the guide ribs in order to guide a portion of the cooling fluid to a bottom of the cooling passage between the guide ribs or to side walls adjacent to the bottom.

The cooling passage may be formed with a first heat conduction region, in which heat transfer is lowered in the bottom or the side walls adjacent to the bottom, and assuming that a distance between adjacent guide ribs is "L", the first heat conduction region may be a region corresponding to a distance less than L/2 in the movement direction of the cooling fluid.

Referring to the distance between the adjacent guide ribs as "L", a second heat conduction region may be a region corresponding to a distance that may be equal to or more than L/2, in addition to the first heat conduction region, and the second heat conduction region may be a region to which the cooling fluid moved to an upper portion of the guide rib is dropped.

The opening may be one of a hole having a predetermined size and a slit having a predetermined length.

The opening may have a diameter reduced toward a rear surface of the guide rib from a front surface thereof.

The opening may be formed at a height of H/2 or 2H/3 of an overall height (H) of the guide rib.

The opening may be configured such that holes, each having a predetermined size, are disposed in a center of the guide rib, and slits, each having a predetermined length, are disposed to left and right sides of the holes.

The opening may be formed of a hole so as to be inclined downward toward a center of the first heat conduction region when the guide rib is viewed from the top, in order for the cooling fluid to be supplied to a center of the cooling passage in a width direction thereof in the first heat conduction region.

The opening may be formed of a hole so as to be inclined toward the side walls of the cooling passage when the guide rib is viewed from the top, in order for the cooling fluid to be supplied to a center of the cooling passage and the left and right side walls thereof.

When the opening is one of a hole and a slit, the opening may be horizontally formed.

When the opening is one of a hole and a slit, the opening may be formed so as to be inclined downward toward the first heat conduction region.

When the opening is one of a hole and a slit, the opening may be formed so as to be inclined upward.

The guide rib may further include a groove longitudinally formed in an upper surface thereof in order to guide the movement of the cooling fluid.

In accordance with another aspect of the present disclosure, a gas turbine blade includes a plurality of guide ribs spaced apart from each other in a movement direction of a cooling fluid in order to guide movement of the cooling fluid flowing along a cooling passage formed in the turbine blade, an inclined portion configured such that an upper surface of each of the guide ribs in a width direction thereof in a front surface thereof coming into contact with the cooling fluid is inclined downward toward a bottom of the cooling passage, and an opening formed in the front surface of each of the guide ribs such that a portion of the cooling fluid is supplied to the bottom of the cooling passage between the guide ribs or to a first heat conduction region in which heat transfer is relatively lowered in side walls adjacent to the bottom.

The inclined portion may have one of a streamlined round shape and a flat shape, and the movement of the cooling fluid may be guided by the inclined portion.

The inclined portion may guide the movement of the cooling fluid to the first heat conduction region and a second heat conduction region adjacent thereto, and the inclined portion may have a relatively lower angle of inclination in both sides of the guide rib than that in a center thereof.

The opening may be one of a hole having a predetermined size and a slit having a predetermined length, and the opening may have a diameter reduced toward a rear surface of the guide rib from the front surface thereof.

It is to be understood that both the foregoing general description and the following detailed description of the present disclosure are exemplary and explanatory and are intended to provide further explanation of the invention as claimed.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
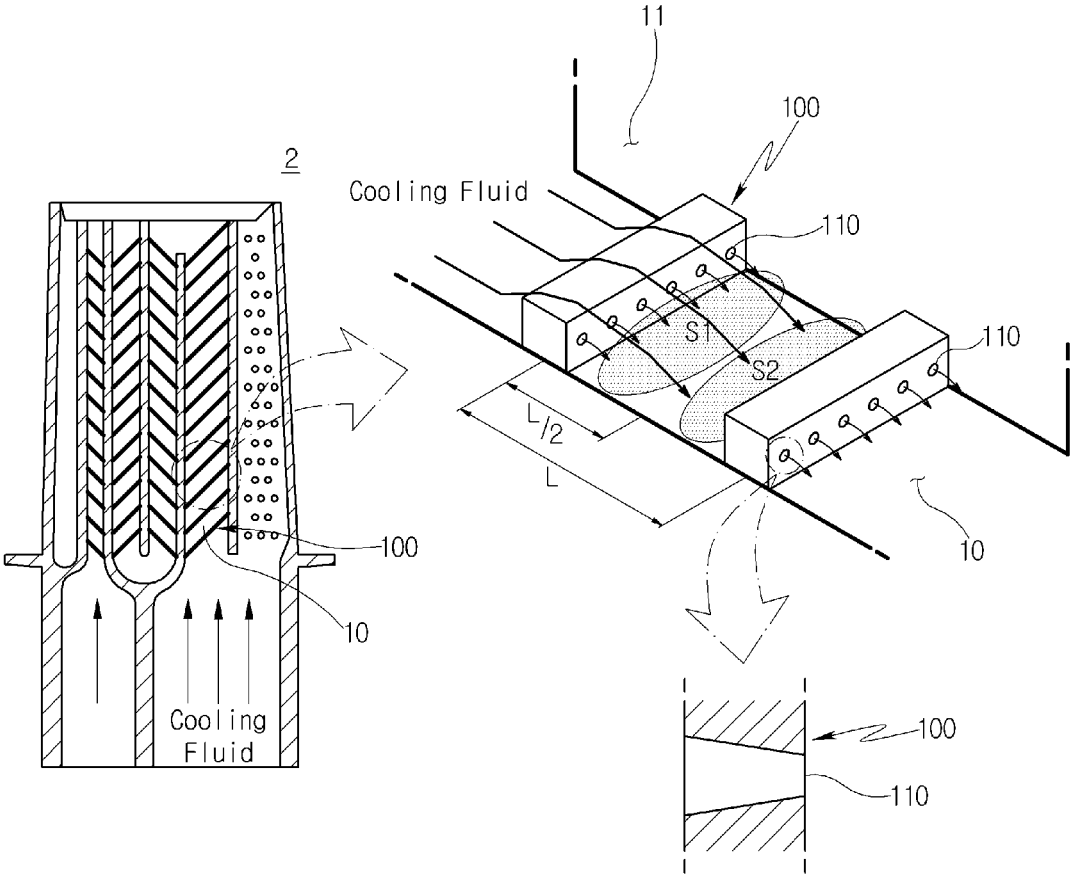
FIG. 1 is a view illustrating the configuration of a gas turbine blade according to a first embodiment of the present disclosure.

Exemplary embodiments of the present disclosure will be described below in more detail with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like parts throughout the various figures and embodiments of the present disclosure.

Figure 2:
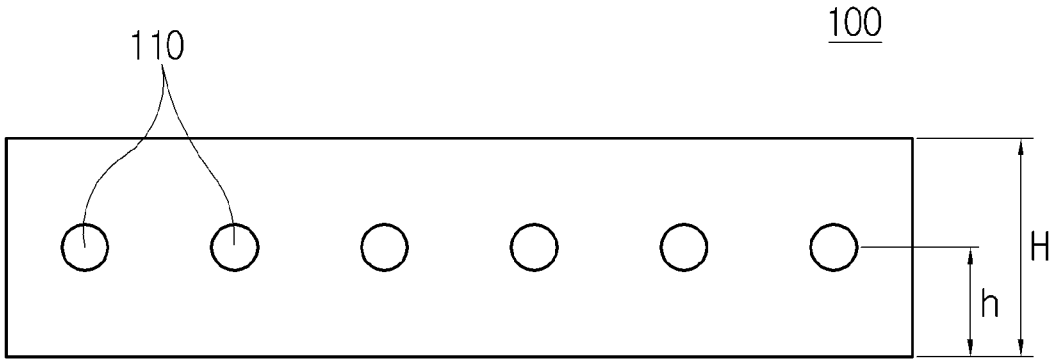
FIG. 2 is a view illustrating an example of the shape of a guide rib according to the first embodiment of the present disclosure.
Figure 3:
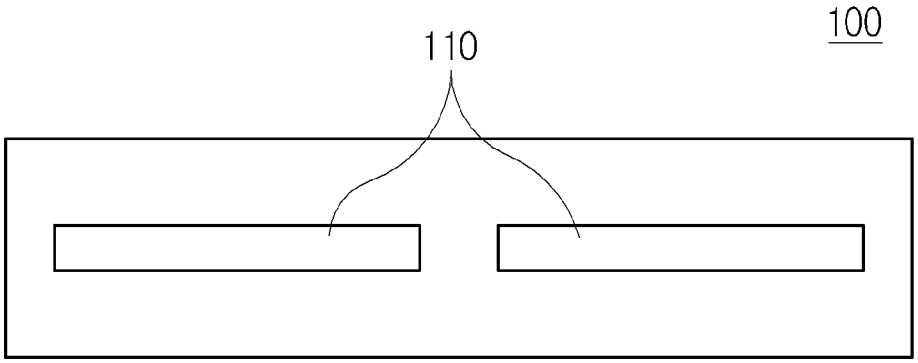
FIG. 3 is a view illustrating another example of the shape of a guide rib according to the first embodiment of the present disclosure.
Figure 4:
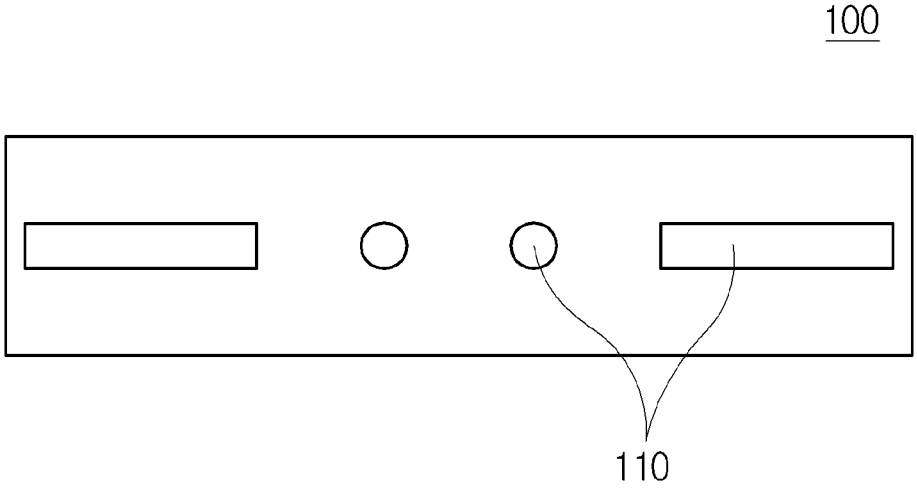
FIG. 4 is a view illustrating still another example of the shape of a guide rib according to the first embodiment of the present disclosure.

A gas turbine blade according to a first embodiment of the present disclosure will be described with reference to the accompanying drawings. FIG. 1 is a view illustrating the configuration of a gas turbine blade according to a first embodiment of the present disclosure. FIGS. 2 to 4 are views illustrating various examples according to the shape of a guide rib according to the first embodiment of the present disclosure.

Referring to FIG. 1, the turbine blade according to the present embodiment includes a guide rib 100 for guiding the movement of a cooling fluid flowing along a cooling passage 10 formed in the turbine blade 2.

The turbine blade 2 and the path of the passage therein are illustrative in the drawings to help understanding of the present disclosure, and may be embodied in different forms.

The guide rib 100 consists of a plurality of guide ribs arranged at predetermined intervals along the cooling passage 10, and serves to perform the overall heat exchange of the turbine blade 2 by guiding the movement path and direction of the cooling fluid.

In the embodiment, each of the guide ribs has a rectangular bar shape, and is disposed so as to be inclined at a predetermined angle in the cooling passage 10. However, the guide rib may be disposed so as not to be inclined, and is not limited to being inclined at a specific angle.

In order to guide the movement of the cooling fluid flowing along the cooling passage 10 formed in the turbine blade 2, the guide ribs 100 are arranged so as to be spaced apart from each other in the movement direction of the cooling fluid.

The cooling passage 10 is not limited to having a specific length, but may have any length as long as the guide ribs 100 are spaced apart from each other at predetermined intervals for the stable movement of the cooling fluid.

In addition, the cooling passage 10 has regions which are partitioned by the guide ribs 100, and each of the regions is largely divided into a first heat conduction region S1 and a second heat conduction region S2 on the basis of the movement direction of the cooling fluid.

The first and second heat conduction regions S1 and S2 are maintained at different temperatures, and thermal equilibrium is attained by heat exchange therebetween. The thermal equilibrium is preferably maintained at a low temperature in consideration of the overall cooling of the turbine blade 2.

In addition, it is preferable for the turbine blade 2 to be generally maintained at a constant temperature, rather than to be locally maintained at a high temperature at a specific position or in a specific section, in order to increase the durability of the expensive turbine blade 2 and improve heat transfer performance and cooling efficiency.

In order to improve the overall cooling performance and efficiency of the turbine blade 2 in the present disclosure, a portion of the cooling fluid is supplied to the first heat conduction region S1, which has low heat transfer performance due to a lack of the cooling fluid supplied thereto, from among the first and second heat conduction regions S1 and S2 formed between the adjacent guide ribs 100, with the consequence that the temperature in the first heat conduction region S1 is lowered by thermal equilibrium.

To this end, the cooling fluid is moved to the first heat conduction region S1 through an upstream one of the guide ribs 100. Referring to the distance between adjacent guide ribs is "L", the first heat conduction region S1 is a region corresponding to a distance less than L/2 in the movement direction of the cooling fluid.

In the drawing, between the two adjacent guide ribs, the first heat conduction region S1 is a left hatching region indicated by an ellipse, and the second heat conduction region S2 is a right region.

The first and second heat conduction regions S1 and S2 are a cooling target region, in which cooling is performed, rather than separately partitioned regions. Each of the guide ribs 100 has an opening 110 formed in the front surface thereof in the width direction thereof, thereby enabling the cooling fluid to be supplied to the first heat conduction region S1.

Referring to FIG. 2, the opening 110 may be one of a hole having a predetermined size and a slit having a predetermined length. In the embodiment, the opening may be a hole, a slit, or a combination thereof.

First, when the opening 110 is a hole, the opening 110 consists of a plurality of holes which are spaced apart from each other at regular intervals in the front surface of the guide rib 100.

The distance between the holes and the diameter of each hole are not especially limited. The number of holes, the distance between holes, and the diameter of each hole may be changed in order for the cooling fluid to stably cool the first heat conduction region S1 via the guide rib 100.

Each of the holes has a circular cross-section, so that the flow resistance of the cooling fluid may be reduced or minimized and the stable flow rate thereof may be maintained. Accordingly, the cooling fluid may be stably supplied to the first heat conduction region S1.

The opening 110 is located at a specific position with regard to the overall height H of the guide rib 100 in consideration of processability. Since the overall height H of the guide rib 100 is several mm, the opening 110 is formed at a height h that is equal to or more than H/2 of the overall height H in order to stably form the guide rib 100.

For example, when the height of the opening 110 is less than H/2, the opening 100 may be unstably formed or be deformed from an intended shape when the guide rib 100 is formed. Therefore, the opening 110 is preferably formed at the above height.

In addition, the opening 110 may be formed at a height of 2H/3 of the overall height of the guide rib 100. In this case, the opening 110 may be stably formed when the guide rib 100 is formed.

Referring to FIG. 3, when the opening 110 is a slit, the opening 110 includes slits that may be symmetrically opened about the front center of the guide rib 100. In this case, the opening 110 is disposed in the form in which it horizontally extends, but it may be disposed in a different form. When the opening 110 is horizontally disposed, it is possible to stably secure the movement and flow rate of the cooling fluid. Therefore, it is possible to improve the cooling performance of the first heat conduction region S1.

Referring to FIG. 4, the opening 110 is configured such that holes, each having a predetermined size, are disposed in the center of the guide rib, and slits, each having a predetermined length, are respectively disposed to the left and right of the holes. When the slits are disposed to the left and right from the center of the guide rib, heat transfer may be stably performed in the first heat conduction region S1 while heat transfer efficiency may be realized in left and right side walls 11 of the cooling passage 10.

In addition, the slits are formed so as to be close to the left and right of the guide rib 100 as much as possible, with the consequence that cooling may be more effectively performed by increasing the flow rate of the cooling fluid supplied to the side walls 11.

In this case, since a portion of the cooling fluid flowing to the cooling passage 10 may flow to the side walls 11, cooling efficiency may be improved through heat transfer to a relatively disadvantageous position for cooling. Thus, it is possible to improve the overall cooling efficiency of the turbine blade 2.

In addition, since the cooling fluid may be simultaneously supplied to the side walls 11 and the center of the cooling passage 10 in the width direction thereof, the cooling fluid is uniformly supplied without bias to a specific position.

In the embodiment, the opening 110 has a diameter reduced toward the rear surface of the guide rib 100 from the front surface thereof. In this case, since the flow rate of the cooling fluid flowing to the first heat conduction region S1 is increased, cooling may be rapidly performed even when a temperature is locally increased, thereby improving cooling efficiency.

In the embodiment, the opening formed in the guide rib may be formed so as to be inclined at a specific angle in order to more effectively cool the first heat conduction region. A detailed description thereof will be given with reference to the drawings.

Figure 5:
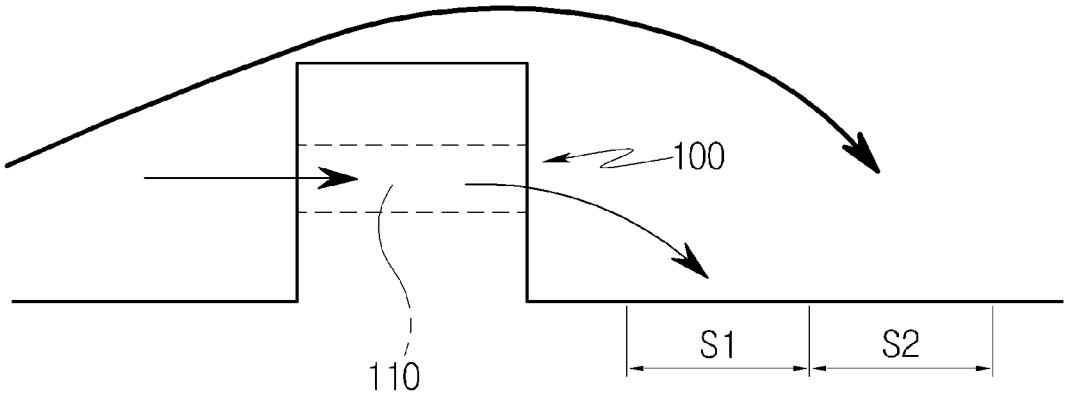
FIG. 5 is a view illustrating an example of the angle of opening of a guide rib according to the first embodiment of the present disclosure.

Referring to FIG. 5, when the opening 110 formed in the guide rib 100 is one of a hole and a slit, the opening 110 is horizontally formed.

When the opening 110 is horizontally formed, the cooling fluid flows to the first heat conduction region S1 via the guide rib 100, as indicated by the arrow.

The heat transfer is performed in the first heat conduction region S1 by the cooling fluid supplied through the opening 110. The second heat conduction region S2 is cooled or thermal equilibrium is attained between the first and second heat conduction regions S1 and S2 by the remaining cooling fluid moved via the upper surface of the guide rib 100, thereby stably achieving cooling.

Figure 6:
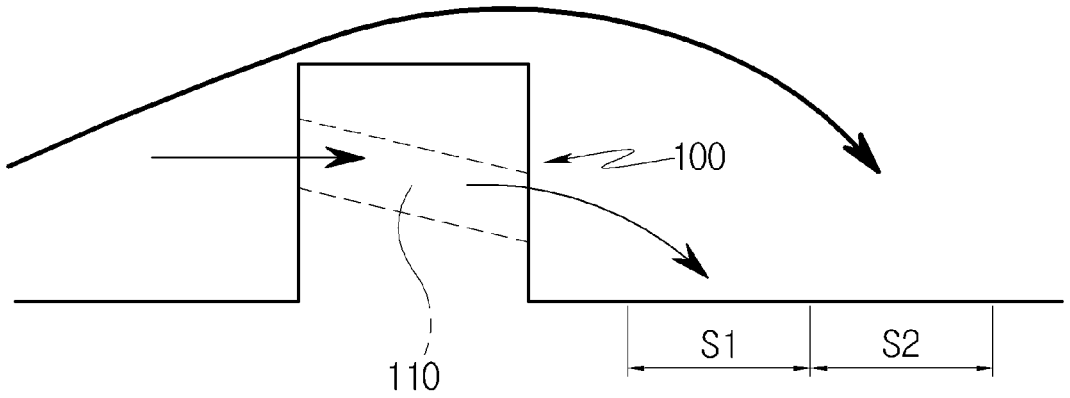
FIG. 6 is a view illustrating another example of the angle of opening of a guide rib according to the first embodiment of the present disclosure.

Referring to FIG. 6, when the opening 110 formed in the guide rib 100 is one of a hole and a slit, the opening 110 is formed so as to be inclined downward toward the first heat conduction region S1.

When the opening 100 is opened in the form illustrated in the drawing, a portion of the fluid supplied to the guide rib 100 is supplied at a position adjacent to the right lower end of the guide rib 100 in the first heat conduction region S1 in the drawing.

In order to compensate a defect in which the cooling fluid is relatively less supplied to the first heat conduction region S1, a portion of the cooling fluid is supplied at the position, with the consequence that the heat transfer is stably performed in the first heat conduction region S1.

Figure 7:
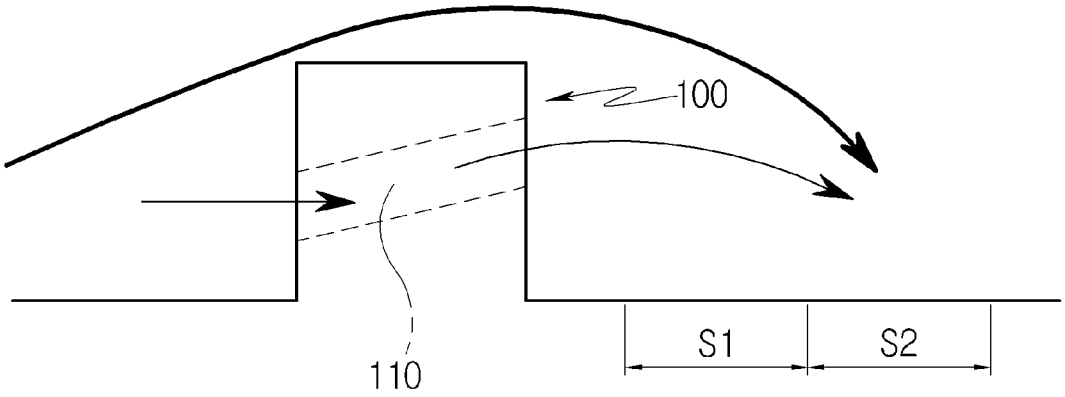
FIG. 7 is a view illustrating still another example of the angle of opening of a guide rib according to the first embodiment of the present disclosure.

Referring to FIG. 7, when the opening 110 formed in the guide rib 100 is one of a hole and a slit, the opening 110 is formed so as to be inclined upward. In this case, the cooling fluid is moved to the first heat conduction region S1 along a trajectory indicated by the thin solid line.

When the opening 110 is formed in the guide rib 100 in various directions as described above, the heat transfer may be stably performed in the first heat conduction region S1 as well as the adjacent side walls 11, and thus the overall cooling efficiency of the turbine blade may be improved.

In the embodiment, the guide rib may guide the movement of the cooling fluid to the specific position of the first heat conduction region according to the angle of opening of the opening. A detailed description will be given with reference to the drawings.

Figure 8:
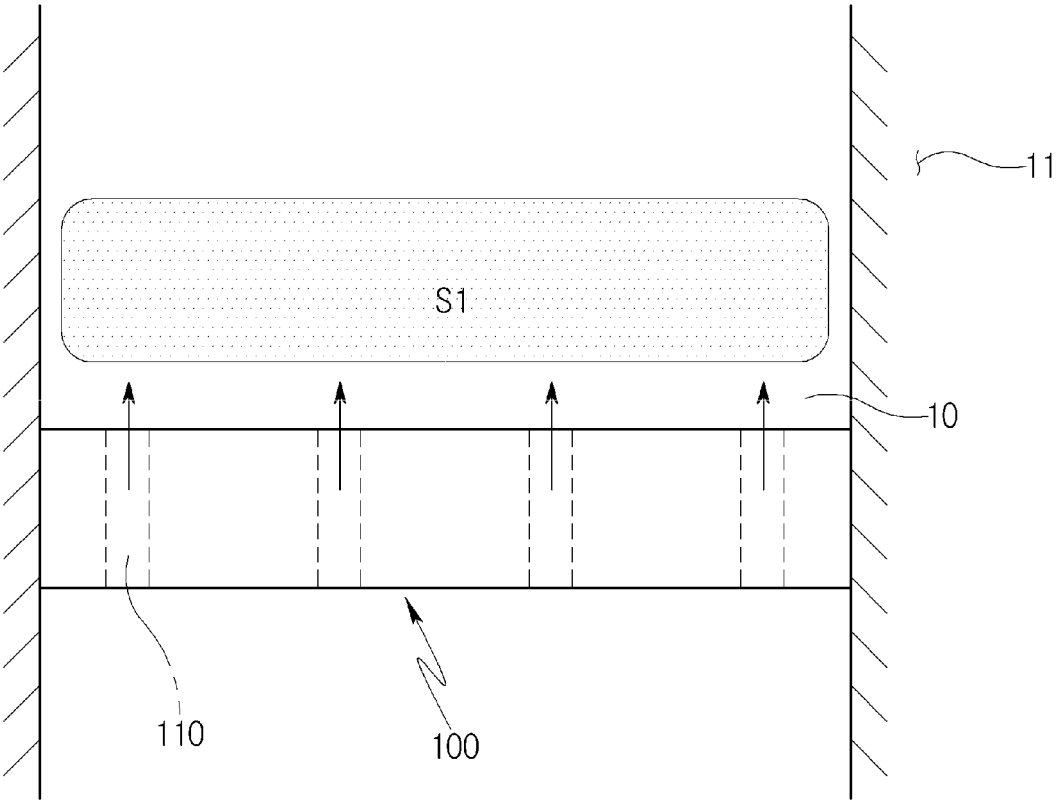
FIG. 8 is a view illustrating an examples of the opening direction of a guide rib according to the first embodiment of the present disclosure.

Referring to FIG. 8, in order for the cooling fluid to be supplied toward the center of the cooling passage 10 in the width direction thereof in the first heat conduction region S1, the opening 110 is formed of a hole so as to be inclined downward toward the center of the first heat conduction region S1 when the guide rib 100 is viewed from the top.

It is preferable that the center of the first heat conduction region S1 is first cooled and the remaining region thereof is then cooled for effective cooling.

In this case, the opening 110 is disposed toward the center of the first heat conduction region. When the cooling fluid is moved through the opening 110 as indicated by the arrows, the cooling fluid is evenly supplied to the first heat conduction region S1. Therefore, cooling is effectively performed. In this case, cooling is intensively performed on the hatching region of the first heat conduction region S1.

The opening 110 is described to be inclined downward toward the center of the first heat conduction region in FIG. 8. However, even when the opening is horizontally formed in the movement direction of the cooling fluid, the cooling of the first heat conduction region S1 may be effectively performed.

Accordingly, it is possible to prevent a temperature from locally increasing in the first heat conduction region S1 and to stably achieve cooling in the cooling passage 10 formed in the turbine blade 2.

Figure 9:
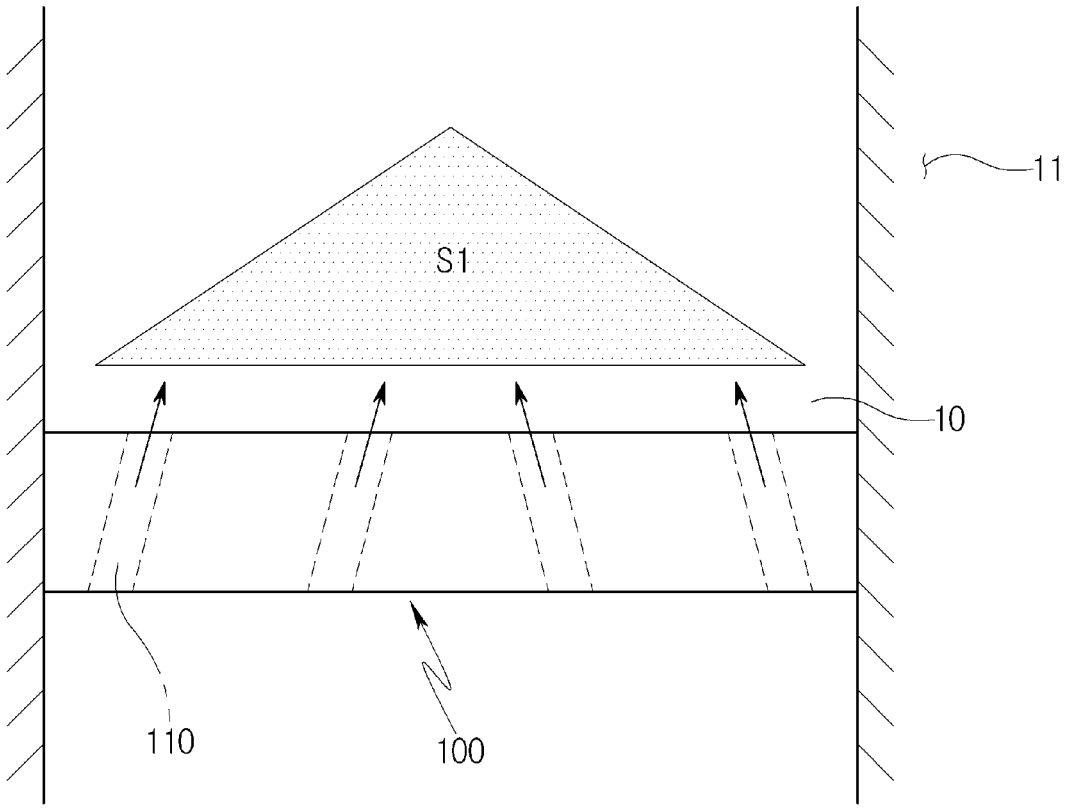
FIG. 9 is a view illustrating another example of the opening direction of a guide rib according to the first embodiment of the present disclosure.

Referring to FIG. 9, in order for the cooling fluid to be supplied to the triangular region of the first heat conduction region S1, as illustrated in the drawing, the opening 110 may be formed in the direction indicated by the arrows so as to be inclined relative to the side walls 11. In this case, the opening 110 may be formed so as to be inclined downward toward the first heat conduction region S1, or be horizontally formed. Thus, the first heat conduction region S1 is intensively cooled by the cooling fluid supplied to the hatching region.

Figure 10:
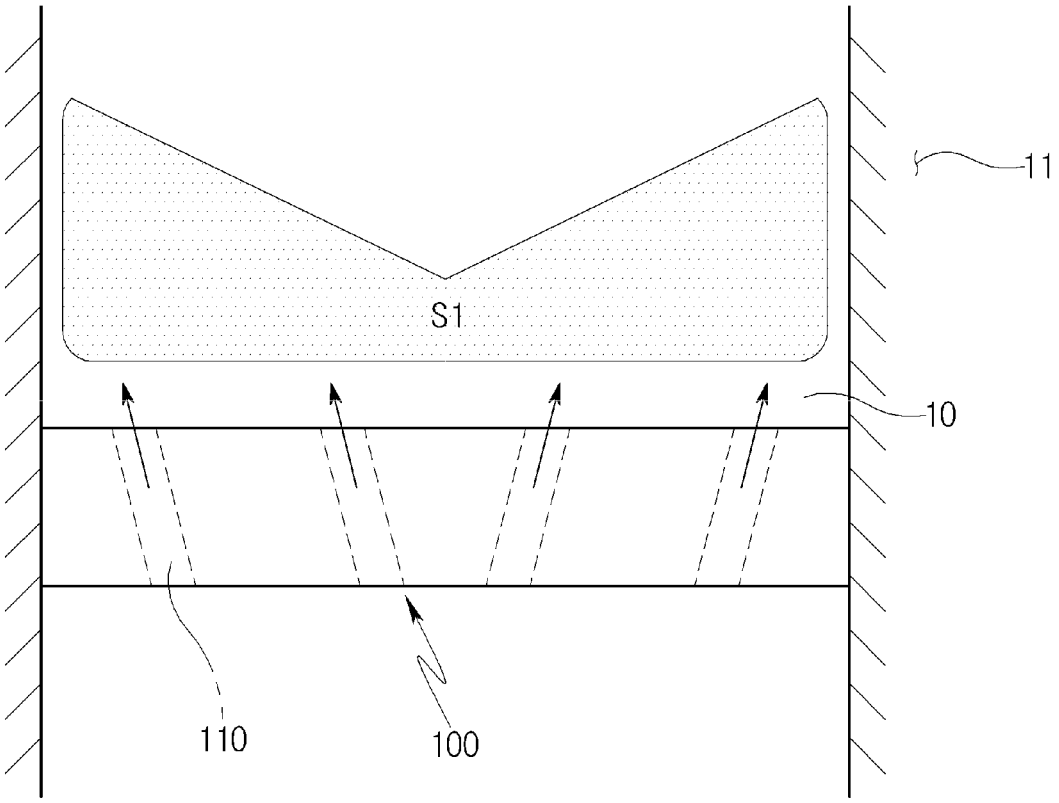
FIG. 10 is a view illustrating still another example of the opening direction of a guide rib according to the first embodiment of the present disclosure.

Referring to FIG. 10, in order for the cooling fluid to be supplied to the center of the cooling passage 10 and the left and right side walls thereof, the opening 110 is formed of a hole so as to be inclined toward the side walls 11 of the cooling passage 10 when the guide rib 100 is viewed from the top.

In this case, a portion of the cooling fluid is supplied to the left and right of the cooling passage and the center of the first heat conduction region S, as indicated by the arrows, cooling is intensively performed on the hatching region of the first heat conduction region S1.

Thus, when the opening 110 is disposed as described above in order to realize optimal heat transfer for each position of the turbine blade 2, it is possible to realize improved or optimal cooling efficiency.

Figure 11:
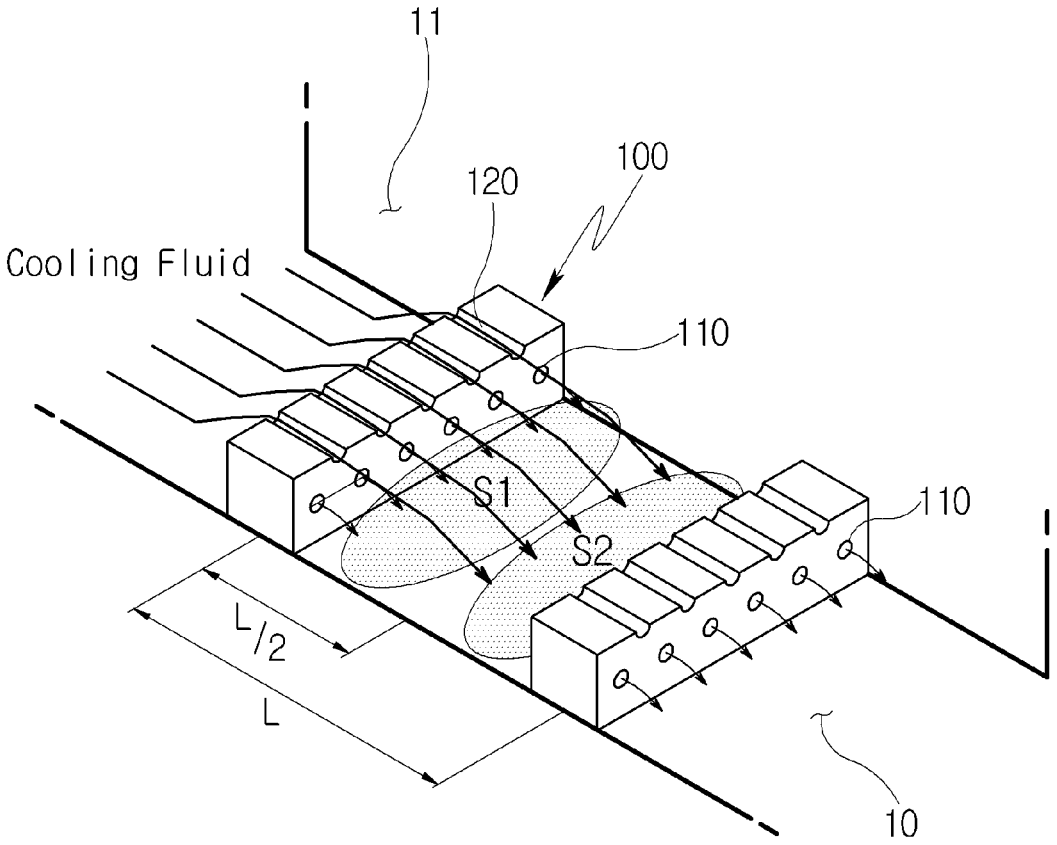
FIG. 11 is a view illustrating grooves formed in guide ribs according to the first embodiment of the present disclosure.

Referring to FIG. 11, the first and second heat conduction regions S1 and S2 are formed in the cooling passage 10 according to the embodiment. The second heat conduction region S2 is a region to which the cooling fluid moved via the upper surface of the guide rib 100 is dropped. After a portion of the cooling fluid introduced through the opening 110 is moved to the second heat conduction region S2, the cooling fluid may partially cool the second heat conduction region S2, thereby improving heat transfer.

Assuming that the distance between adjacent guide ribs is "L", the second heat conduction region S2 is a region corresponding to a distance that is equal to or more than L/2 in the movement direction of the cooling fluid.

In addition, the second heat conduction region S2 is a region to which the cooling fluid moved via the upper surface of the guide rib 100 is dropped.

In the embodiment, the guide rib 100 further include grooves 120 which are longitudinally formed in the upper surface thereof in order to guide the movement of the cooling fluid. Each of the grooves 120 has a semicircular shape, and serves to stably move the cooling fluid and reduce to minimize the occurrence of unnecessary turbulence. Therefore, the groove may be formed as illustrated in the drawing.

The groove 120 may be formed so as to be inclined toward the side walls in the upper surface of the guide rib 100. In this case, heat transfer to the second heat conduction region S2 and heat transfer to the side walls may be simultaneously performed in the cooling passage 10, and thus the cooling performance of the turbine blade 2 may be improved.

As described above, the first heat conduction region S2 is stably cooled by the cooling fluid supplied through the opening 110, and the second heat conduction region S2 is stably cooled by the cooling fluid via the guide rib 100 or the groove 120.

Accordingly, when cooling is stably performed on both the first and second heat conduction regions S1 and S2, cooling efficiency may be improved by thermal equilibrium. Therefore, it is possible to improve the overall cooling efficiency of the turbine blade 2.

Hereafter, a gas turbine blade according to a second embodiment of the present disclosure will be described with reference to the accompanying drawings.

Figure 12:
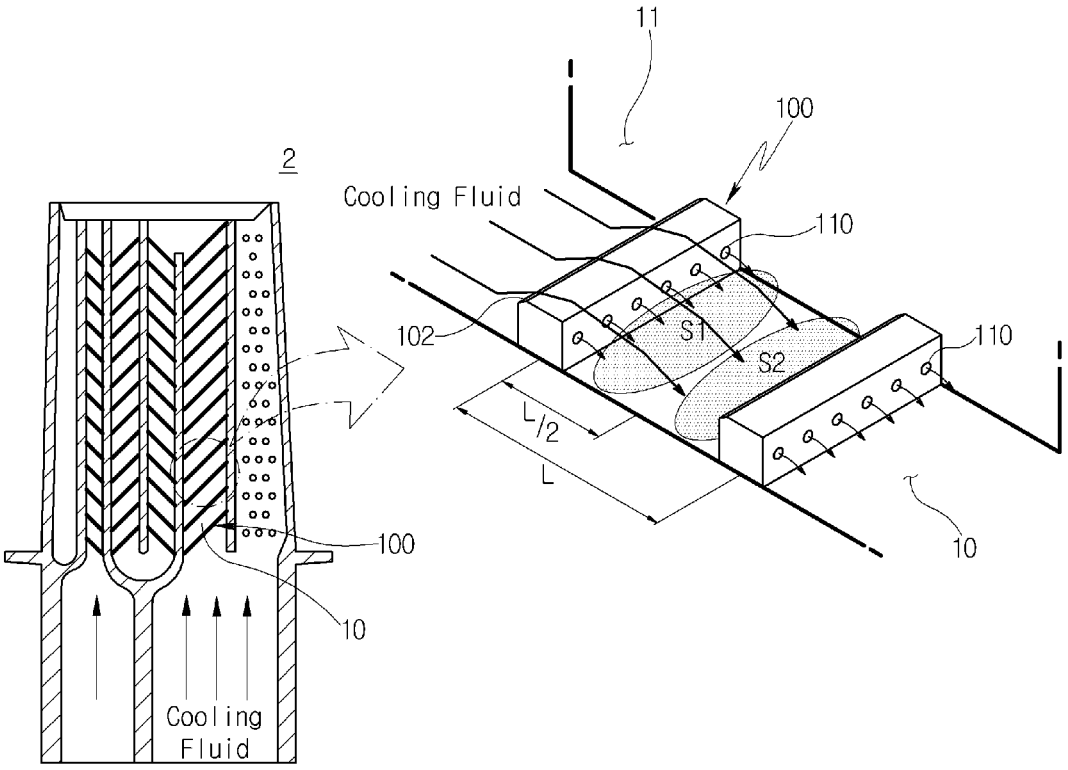
FIG. 12 is a view illustrating the configuration of a gas turbine blade according to a second embodiment of the present disclosure.

Referring to FIG. 12, the gas turbine blade according to the second embodiment of the present disclosure includes a plurality of guide ribs 100 spaced apart from each other in the movement direction of a cooling fluid in order to guide the movement of the cooling fluid flowing along a cooling passage 10 formed in the turbine blade 2, an inclined portion 102 configured such that the upper surface of each of the guide ribs 100 in the width direction thereof in the front surface thereof coming into contact with the cooling fluid is inclined downward toward the bottom of the cooling passage, and openings 110 formed in the front surface of the guide rib 100 such that a portion of the cooling fluid is supplied to the bottom of the cooling passage 10 between the guide ribs or to a first heat conduction region S1, in which heat transfer is relatively low in side walls adjacent to the bottom.

Since the configuration of each opening 110 in the second embodiment is identical or similar to that in the first embodiment, the configuration of the opening in the first embodiment may be applied to the second embodiment.

The inclined portion 102 has one of a streamlined round shape and a flat shape. The movement of the cooling fluid is guided by the inclined portion 102.

The movement trajectory of the cooling fluid may be changed according to the angle of inclination and shape of the inclined portion 102. When the openings 110 and the inclined portion 102 are combined in order to maintain optimal cooling efficiency in the first and second heat conduction regions S1 and S2, the drop position of the cooling fluid may be easily controlled in the second heat conduction region S2.

For example, when the inclined portion 102 has a relatively low angle of inclination, the drop position of the cooling fluid is changed. In this case, the favorable angle of inclination or shape of the inclined portion to perform heat transfer is previously obtained through modeling, and this angle or shape is applied to the actual turbine blade 2, thereby allowing optimal cooling efficiency to be maintained.

Figure 13:
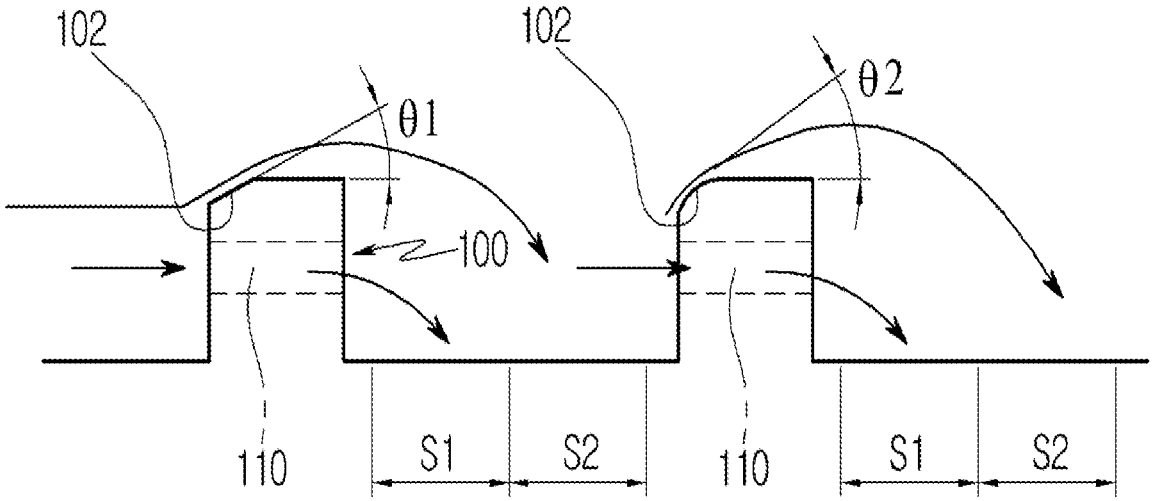
FIG. 13 is a view illustrating an example of an inclined portion according to the second embodiment of the present disclosure.
Figure 14:
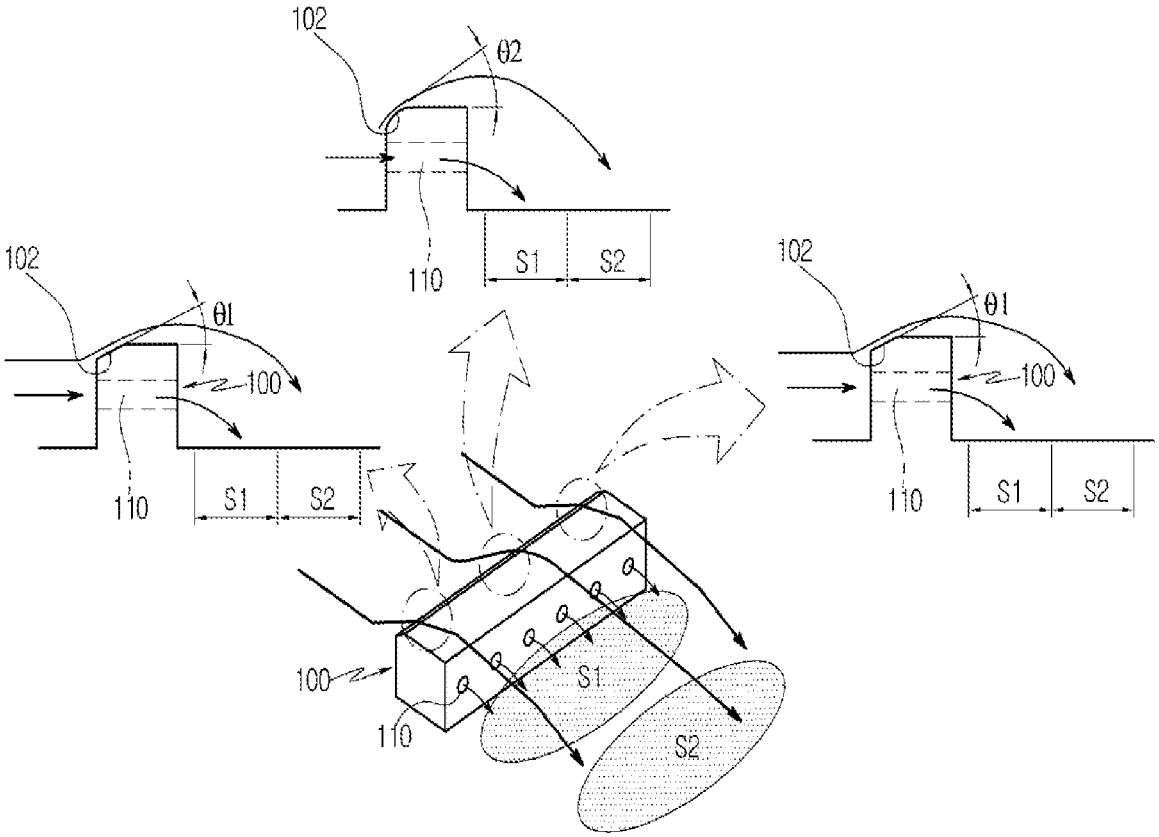
FIG. 14 is a view illustrating another example of an inclined portion according to the second embodiment of the present disclosure.

Referring to FIGS. 13 and 14, when the inclined portion 102 has a low angle of inclination θ1, the cooling fluid is easily dropped to the second heat conduction region S2 along an expectation trajectory.

If the inclined portion 102 is maintained at a high angle of inclination θ2, the expectation trajectory of the cooling fluid may be easily adjusted by changing the angle.

Accordingly, it is possible to maintain the optimal cooling efficiency of the turbine blade 2 even though the layout or shape of the cooling passage 10 is complicatedly changed.

Referring to FIG. 14, the inclined portion 102 serves to guide the movement of the cooling fluid to the first heat conduction region S1 and the second heat conduction region S2 adjacent thereto. The inclined portion 102 has a relatively lower angle of inclination in both sides of the guide rib 100 than that in the center thereof.

In this case, since the cooling fluid is dropped to the side walls or the first and second heat conduction regions S1 and S2 adjacent thereto via the guide rib 100, heat transfer performance is improved even in the side walls in which heat transfer may be adversely performed.

Thus, cooling may be mainly performed on the bottom of the cooling passage 10 and may be simultaneously performed on the side walls, and therefore the cooling efficiency of the turbine blade 2 may be remarkably improved.

The cooling fluid is moved to the first heat conduction region S1 via an upstream one of the guide ribs 100. Assuming that the distance between adjacent guide ribs is "L", the first heat conduction region S1 is a region corresponding to a distance less than L/2 in the movement direction of the cooling fluid.

Each of the openings 110 may be one of a hole having a predetermined size and a slit having a predetermined length. In the embodiment, the opening may be a hole, a slit, or a combination thereof. The distance between the holes and the diameter of each hole are not especially limited. The number of holes, the distance between holes, and the diameter of each hole may be changed in order for the cooling fluid to stably cool the first heat conduction region S1 via the guide rib 100.

Each of the holes has a circular cross-section, so that the flow resistance of the cooling fluid may be minimized and the stable flow rate thereof may be maintained. Accordingly, the cooling fluid may be stably supplied to the first heat conduction region S1.

In the embodiment, the opening 110 has a diameter reduced toward the rear surface of the guide rib 100 from the front surface thereof, as illustrated in FIG. 2. In this case, since the flow rate of the cooling fluid flowing to the first heat conduction region S1 is increased, cooling may be rapidly performed even when a temperature is locally increased, thereby improving cooling efficiency.

As is apparent from the above description, the exemplary embodiments of the present disclosure can stably guide the movement of a cooling fluid supplied to first and second heat conduction regions by a guide rib arranged in a gas turbine blade, and thus improve heat transfer performance by thermal equilibrium.

The exemplary embodiments of the present disclosure can improve heat transfer efficiency in the first heat conduction region having relativity heat transfer efficiency, and thus reduce or prevent a local increase in temperature.

The exemplary embodiments of the present disclosure can improve heat transfer efficiency in a side wall together with a cooling passage, and thus improve the overall cooling efficiency of the turbine blade.

While the present invention has been described with respect to the specific embodiments, it will be apparent to those skilled in the art that various changes and modifications may be made without departing from the spirit and scope of the invention as defined in the following claims.

The breadth and scope of the present disclosure should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

What is claimed is:

1. A gas turbine blade, comprising:

a cooling passage; and a plurality of guide ribs disposed in the cooling passage and spaced apart from each other in a movement direction of a cooling fluid flowing through the cooling passage, each of the plurality of guide ribs being configured to guide the cooling fluid and comprising:

a base abutting an inner surface of the turbine blade;

an upper surface disposed opposite to the base;

front and rear surfaces respectively communicating with each of the base and the upper surface;

an opening defined in each of the front and rear surfaces and configured to guide a first portion of the cooling fluid that strikes the front surface and is guided to a first heat conduction region including at least one of the inner surface of the turbine blade between adjacent guide ribs of the plurality of guide ribs and side walls of the cooling passage between the adjacent guide ribs; and a longitudinal groove defined in the upper surface and configured to guide a second portion of the cooling fluid that strikes the front surface and is guided to a second heat conduction region including a region of the inner surface of the turbine blade that is disposed between the adjacent guide ribs downstream of the first heat conduction region, the longitudinal groove having a cross section extending from the front surface to the rear surface.

2. The gas turbine blade according to claim 1, wherein the plurality of guide ribs are spaced apart from each other by a distance L, and wherein the first heat conduction region has a length less than L/2 in the movement direction of the cooling fluid.

3. The gas turbine blade according to claim 2, wherein the second heat conduction region has a length less than or equal to L/2 in the movement direction of the cooling fluid.

4. The gas turbine blade according to claim 1, wherein a diameter of the opening reduces from a front surface of the guide rib toward a rear surface of the guide rib.

5. The gas turbine blade according to claim 1, wherein an overall height of the guide rib is "H", and a height of the opening is in the range of H/2 to 2H/3.

6. The gas turbine blade according to claim 2, wherein the opening includes a hole that is inclined downward toward a center of the first heat conduction region that supplies the cooling fluid to a center of the cooling passage in a width direction thereof in the first heat conduction region.

7. The gas turbine blade according to claim 1, wherein the first heat conduction region is a region adjacent to the rear surface of each of the plurality of guide ribs in the movement direction of the cooling fluid, and the second heat conduction region is a region adjacent to the front surface of each of the plurality of guide ribs in the movement direction of the cooling fluid.

8. A gas turbine blade, comprising:

a plurality of guide ribs spaced apart from each other in a movement direction of a cooling fluid that guide movement of the cooling fluid flowing along a cooling passage formed in the turbine blade; and an opening defined in each of the guide ribs that guides a portion of the cooling fluid to a lower portion of the cooling passage between the guide ribs or to side walls adjacent to the lower portion, wherein the guide ribs respectively include a longitudinal groove defined in an upper surface of the rib that guides the movement of the cooling fluid, the grooves having a semicircular shape, and wherein a diameter of the opening reduces from a front surface of the guide rib toward a rear surface of the guide rib.

* * * * *